US005108204A

United States Patent [19]

Suemune et al.

[11] Patent Number: 5,108,204

[45] Date of Patent: Apr. 28, 1992

[54] PROTECTIVE CIRCUIT FOR A PRINTER DRIVER

[75] Inventors: Toshiro Suemune; Shigeru Takebu, both of Tokyo, Japan

[73] Assignee: Oki Electric Industry Co., Ltd., Tokyo, Japan

[21] Appl. No.: 501,025

[22] Filed: Mar. 29, 1990

[30] Foreign Application Priority Data

Mar. 31, 1989 [JP] Japan ..... 1-36348[U]

[51] Int. Cl.[5] ..... B41J 29/38

[52] U.S. Cl. ..... 400/54; 400/74; 318/434; 361/23

[58] Field of Search ..... 410/54, 74, 322, 903; 318/434, 685, 696; 361/23, 24, 30, 31, 33, 86, 87, 89, 91

[56] References Cited

U.S. PATENT DOCUMENTS 4,346,371 8/1982 Ida ..... 361/23
4,559,577 12/1985 Shiji ..... 318/434
4,633,358 12/1986 Nagano ..... 318/434
4,725,765 2/1988 Miller ..... 318/434
4,937,561 6/1990 Sasaki ..... 361/30
4,947,091 8/1990 Fukuoka ..... 318/434

FOREIGN PATENT DOCUMENTS 5861 1/1987 Japan ..... 400/322

*Primary Examiner*—David A. Wiecking
*Assistant Examiner*—Steven S. Kelley
*Attorney, Agent, or Firm*—Spencer, Frank & Schneider

[57] ABSTRACT

In a protective circuit for a printer driver energized from a drive power supply, and associated with a control circuit for controlling the current supply to the printer driver, and connected to a power supply, a first circuit detects a malfunction of the control circuit with a first predetermined time T1 and resets the control circuit, and a second circuit detects a breakdown of the motor drive transistor with a second predetermined time T2 longer than the first predetermined time, and interrupts an input power supply.

14 Claims, 4 Drawing Sheets

INPUT MD

TRANSISTOR 1
ON
OFF
Vc
Vb

NODE N2

OUTPUT Y1
High

OUTPUT Y2
High

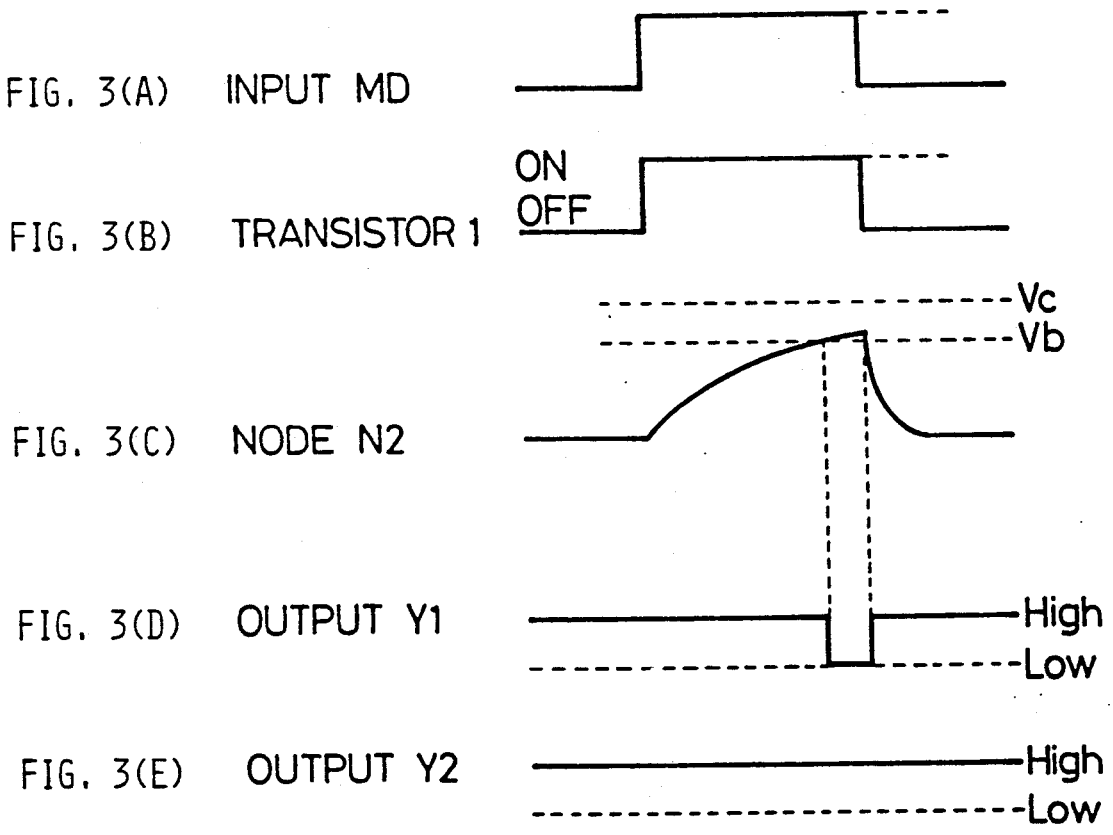
FIG. 3(A) INPUT MD
ON
OFF
FIG. 3(B) TRANSISTOR 1
Vc
Vb
FIG. 3(C) NODE N2
FIG. 3(D) OUTPUT Y1
High
Low
FIG. 3(E) OUTPUT Y2
High
Low INPUT MD
Low

TRANSISTOR 1
ON
OFF

NODE N2
Vc
Vb
T1
T2

OUTPUT Y1
High
Low

OUTPUT Y2
High
Low

PROTECTIVE CIRCUIT FOR A PRINTER DRIVER

BACKGROUND OF THE INVENTION

The present invention relates to a protective circuit for a printer driver.

In a serial printer in which a stepping motor is used for driving a print head for the purpose of spacing or line feed, an over-driving scheme is often employed for quickly moving the print head. In an over-driving scheme, a power supply having a voltage higher than the rated voltage of the motor is applied so that the current through the coil rises quickly. The application of the voltage is commenced when the coil of each phase begins to be selected, and terminated before the current through the coil becomes excessive. When the transistor is kept ON longer than usual, the current through the coil becomes excessive and the coil in the motor may burn out. To protect the motor coil from such an excessive current, a fuse is provided so that when the current becomes excessive, the fuse is blown and the current to the motor coil is interrupted.

A drawback in the above-mentioned prior art protective circuit is that it is necessary to exchange the fuse each time the protective circuit has operated to blow the fuse. This is a serious disadvantage particularly where the reason for the excessive current is a malfunction of the CPU in the control circuit, rather than the breakdown of the motor drive transistor.

SUMMARY OF THE INVENTION

Accordingly, an object of the present invention is to provide a protective circuit which does not blow the fuse when the excessive current through the motor coil is due to a malfunction of the control circuit.

A protective circuit according to the invention is for a printer driver associated with a control circuit for controlling the printer, and energized from a drive power supply. The protective circuit comprises:

- a first circuit detecting a first type of abnormality, such as a malfunction of the control circuit, with a first predetermined time T1 and resetting said control circuit; and
- a second circuit detecting a second type of abnormality, such as a breakdown of a transistor in the printer driver, with a second predetermined time T2 longer than the first predetermined time, and interrupting said driver power supply.

BRIEF DESCRIPTION OF THE DRAWINGS

FIGS. 3A-E are time charts showing the voltages and signals at various parts of the circuit of FIG. 1, when the motor drive transistor is kept ON longer than usual due to a malfunction of the control circuit.

DETAILED DESCRIPTION OF THE PREFERRED EMBODIMENTS

An embodiment of the invention will now be described with reference to FIG. 1.

Figure 1:
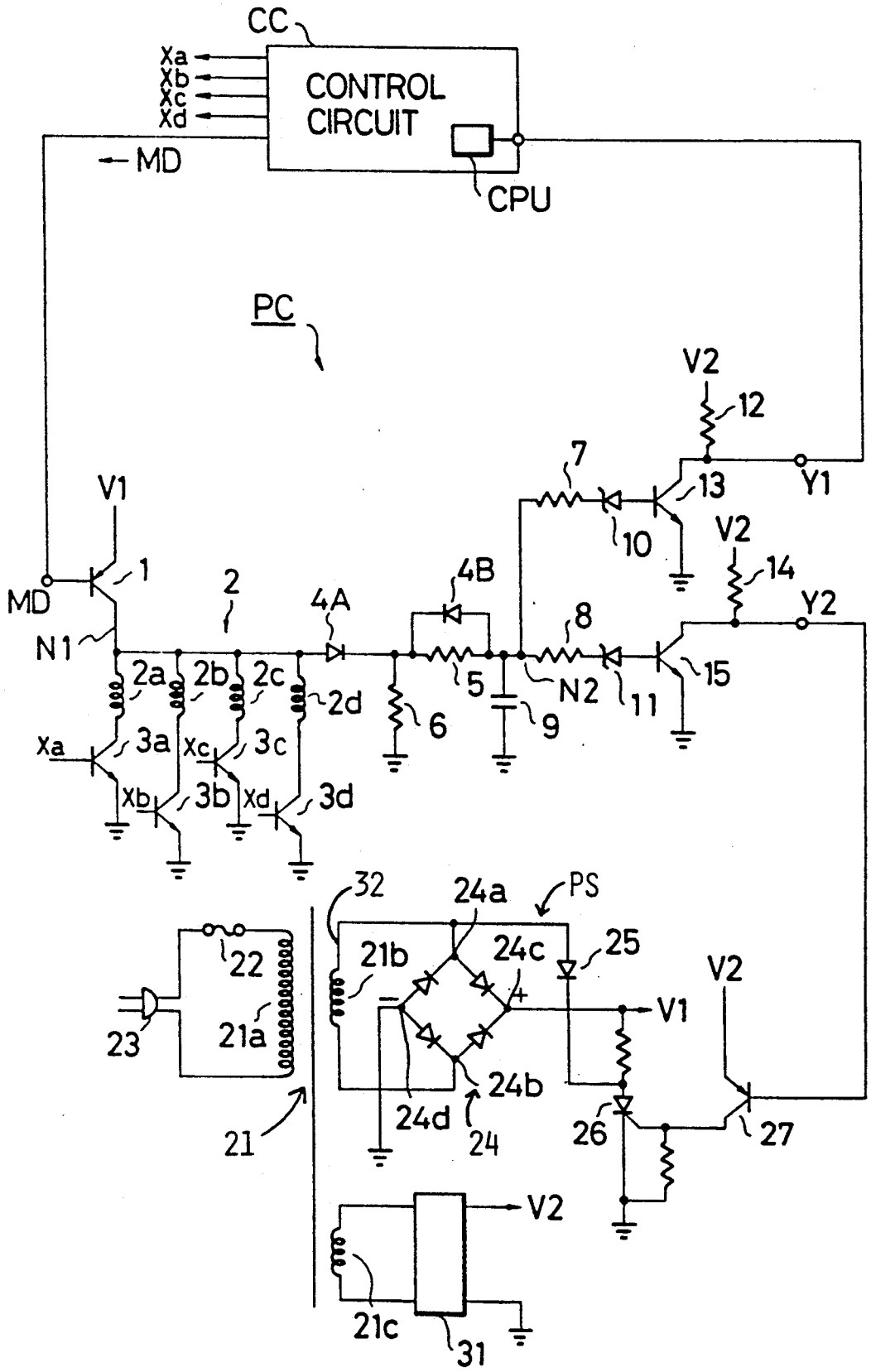
FIG. 1 is a circuit diagram showing a protective circuit of an embodiment of the invention.

In FIG. 1, the protective circuit PC of this embodiment is for protecting a motor 2 from over current. The motor 2 has coils 2*a* to 2*d* of the respective phases, each coil having one end respectively connected to the collector of a corresponding phase transistors 3*a* to 3*d* of the NPN type, the emitters of which are grounded, and the bases of which are connected to receive phase control signals Xa to Xd from a control circuit CC. The phase control signals Xa to Xd are turned ON in a predetermined sequence.

The other ends of the coils 2*a* to 2*d* are connected together at a node N1, and to the collector of a motor drive transistor 1 of the PNP type, the emitter of which is connected to an over-drive voltage terminal V1 of 38 V, for example. The motor drive transistor 1 has its base connected to an input terminal MD to receive a motor drive signal, also denoted by MD, from the control circuit CC, and serves to control the period of time during which the overdrive voltage is applied. This period of time for which the overdrive voltage is applied is commenced when each of the phase control signal Xa to Xd begins to be turned ON and ends before the current through the coils becomes excessive, the current being increased gradually because of the inductance of the coil.

The protective circuit PC of this embodiment comprises a diode 4A having its anode connected to the node N1, a capacitor 9 having one electrode connected through a resistor 5 to the cathode of the diode 4A. The other electrode of the capacitor 9 is grounded. When the transistor 1 in ON, the capacitor 9 is charged through the resistor 5 with a time constant dependent on the resistance of the resistor 5 and the capacitance of the capacitor 9. Another resistor 6 is connected across the series connection of the resistor 5 and the capacitor 9, and a diode 4B is connected to bypass the resistor 5 for a discharging current from the capacitor 9 and through the resistor 6. The rate of discharge is therefore determined by the time constant dependent on the resistance of the resistor 6 and the capacitance of the capacitor 9.

The potential on a node N2 which is a junction joining the resistor 5 and the capacitor 9, varies gradually as the capacitor 9 is charged and discharged. The node N2 is connected through a resistor 7 to a cathode of a Zener diode 10, the anode of which is connected to the base of a transistor 13 of the NPN type, having its emitter grounded and having its collector connected through a resistor 12 to a power supply line V2 (e.g., +5 V). The collector of the transistor 13 forms a first output terminal Y1 of the protective circuit PC. The node N2 is also connected through a resistor 8 to a cathode of a Zener diode 11, the anode of which is connected to the base of a transistor 15 of the NPN type, having its emitter grounded and having its collector connected through a resistor 14 to the power supply line V2. The collector of the transistor 15 forms a second output terminal Y2 of the protective circuit PC.

When the potential on the node N2 exceeds the Zener voltage Vb of the Zener diode 10 the transistor 13 is turned on and the potential on the output terminal Y1 is lowered. When the potential on the node N2 exceeds the Zener voltage Vc of the Zener diode 11 the transistor 15 is turned on and the potential on the output terminal Y2 is lowered. The Zener voltage Vb of the Zener diode 10 is lower than the Zener voltage Vc of the Zener diode 11.

FIG. 1 also shows power supply circuit PS for the driver. This power supply circuit has a transformer 21 having its primary winding 21*a* connected through a fuse 22 to a plug 23. The secondary winding 21*b* of the transformer 21 is connected across AC terminals 24*a* and 24*b* of a full-wave rectifier in the form of a diode bridge 24. The positive DC terminal 24*c* of the diode bridge 24 forms the power supply line V1 providing a positive power supply to the motor coil 2*a* through the motor drive transistor 1.

The negative DC terminal 24*d* of the diode bridge 24 is connected to the ground. One end 32 of the secondary winding 21*b* is also connected to an anode of a diode 25, the cathode of which is connected to an anode of a thyristor (silicon-controlled rectifier) 26. The cathode of the thyristor 26 is grounded. The gate of the thyristor 26 is connected to a collector of a transistor 27, the emitter of which is connected to the power supply line V2. The base of the transistor 27 is connected to the second output terminal Y2 of the protective circuit PC.

Another secondary winding 21*c* of the transformer 21 is connected through a rectifier circuit 31 and its DC output forms the power supply line V2 of +5 V, for example, which are supplied to the control circuit CC, the protective circuit PC, and various other control circuits in the printer.

Figures 2A, 2B, 2C, 2D, 2E:
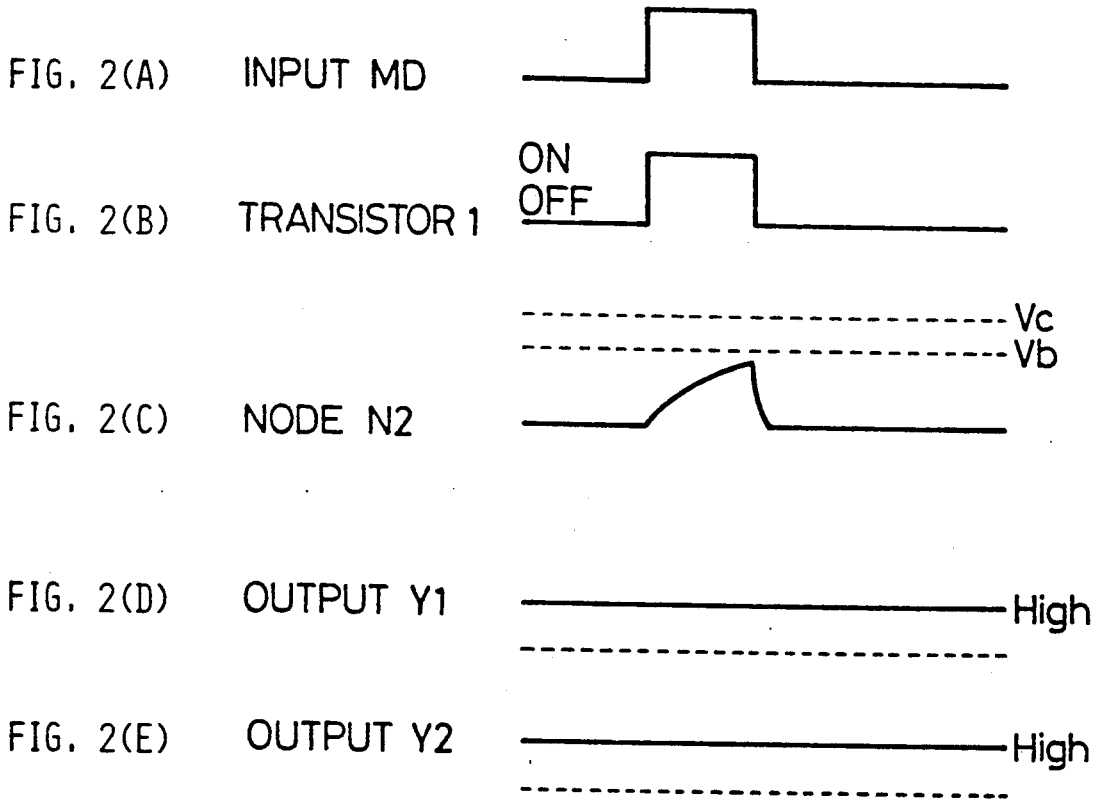
FIGS. 2A-E are time charts showing the voltages and signals at various parts of the circuit of FIG. 1, when the circuit is operating normally.

FIGS. 2(A)-2(E) show the operation in the normal condition of the protective circuit of FIG. 1. The motor drive signal MD on the input terminal MD is kept ON for a period of time within a certain range. While the motor drive signal MD is ON, the motor drive transistor 1 is ON, and the capacitor 9 is charged through the resistor 5. The potential on the node N2 therefore rises as shown in FIG. 2(C). This potential however does not reach the Zener voltage Vb or the Zener voltage Vc, before the motor drive signal MD falls, when the potential on the node N2 begins to fall. Accordingly, the potentials on the output terminals Y1 and Y2 are both kept High.

FIGS. 3(A)-3(E) show the operation which takes place when the CPU malfunctions, e.g., the motor drive signal MD is turned ON due for example to a noise, and is kept ON longer than the above-mentioned fixed time period.

In this case as well, while the motor drive signal MD is ON, the motor drive transistor 1 is ON, and the capacitor 9 is charged through the resistor 5. The potential on the node N2 therefore rises as shown at FIG. 3(C). Because in this case the transistor is kept ON longer than in the normal situation, the potential on the node N2 exceeds the the Zener voltage Vb. Accordingly, the transistor 13 is turned ON, and the potential on the output terminal Y1 falls. When the potential on the output terminal Y1 falls, the CPU in the control circuit CC is reset, and the CPU of the control circuit CC therefore escapes from the malfunctioning state. The motor drive signal MD is therefore turned OFF, and the motor drive transistor 1 is therefore turned OFF, and the capacitor 9 is therefore discharged, and the operation is restarted. Thus, the motor coil is protected from over current, while at the same time the undesirable blowing off of the fuse is prevented.

FIGS. 4(A)-4(D) show the operation which takes place when the motor drive transistor 1 breaks down and is kept ON.

Figures 4A, 4B, 4C, 4D, 4E:
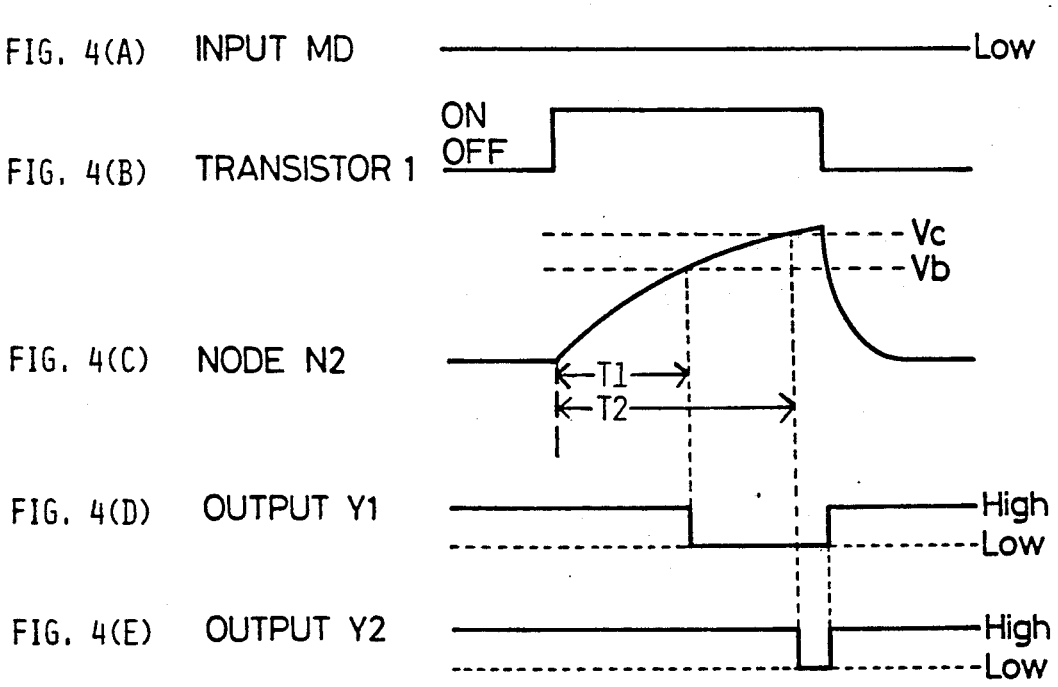
FIGS. 4A-E are time charts showing the voltages and signals at various parts of the circuit of FIG. 1, when the motor drive transistor is kept ON due to breakdown of the motor drive transistor.

In this case, as the motor drive transistor 1 is kept ON, the capacitor 9 is charged through the resistor 5. The potential on the node N2 therefore rises as shown at FIG. 4(C). Because in this case the transistor 1 is kept ON, the potential on the node N2 exceeds the the Zener voltage Vb and then the Zener voltage Vc. When Zener voltage Vb is exceeded, the CPU of the control circuit CC is reset. However, the motor drive transistor 1 is kept ON because it is in the break-down state, and is no longer controlled by the motor drive signal MD. When the Zener voltage Vc is exceeded, the transistor 15 is turned ON, and the potential on the output terminal Y2 falls. As a result, the transistor 27 is turned ON and the thyristor 26 is turned ON, so a large current, which is a short-circuit current, flows through the thyristor, and the secondary winding 21*b*. Accordingly, a large current flows through the primary winding 21*a* and the fuse 22. The fuse 22 is therefore blown, and the connection with the power supply is thereby interrupted.

The time T1 is so set that it is a little longer than the fixed time interval for which the motor drive signal is ON. The time T1 is also so set that it is shorter than the time T2 at which it is necessary to interrupt the current in order to protect the circuit components, particularly the motor coil from the excessively continuing current. The exact value of the time T1 can be determined through experience and experiments.

In the above embodiment, it is so arranged that when the motor drive transistor breaks down, the fuse is blown to disconnect the entire circuit from the main power supply. However, what is important is that the power supply to the drive transistor is interrupted, so it may alternatively be so arranged that the fuse is inserted in series with the secondary winding 21*b* or in series with the drive power supply line V1.

What is claimed is:

1. A protective circuit for a printer driver energized from a drive power supply and associated with a control circuit for controlling the printer and controlling the operation of said printer driver, said protective circuit comprising:

a first circuit for detecting a first type of abnormality within a first predetermined time T1, and resetting said control circuit; and a second circuit for detecting a second type of abnormality within a second predetermined time T2, said predetermined time T2 being longer than said first predetermined time, and interrupting said driver power supply wherein said printer driver further comprises a fuse for interrupting the drive power supply, and means responsive to said second circuit for causing such a large current to flow through said fuse as to blow said fuse.

2. The circuit of claim 1, wherein said control circuit comprises a microcomputer, and said resetting of said control circuit comprises resetting of said microcomputer.

3. The circuit of claim 2, wherein said first type of abnormality is a malfunction of the microcomputer.

4. The circuit of claim 1, wherein said printer driver further comprises a transistor for driving a motor for driving a print head of the printer, and said second type of abnormality is a breakdown of said transistor.

5. A protective circuit for a printer driver having a motor and a motor drive transistor for permitting a current to flow through the motor from a drive power supply, a control circuit being associated with said printer driver for controlling the operation of said motor drive transistor, said protective circuit comprising:

a first circuit responsive to an ON state of said motor drive transistor, said first circuit producing a first signal when the ON state continues over a first predetermined time T1, and resetting said control circuit; and a second circuit responsive to the ON state of said motor driver transistor and producing a second signal when said ON state is continuous over a second predetermined time T2 longer than said first predetermined time, and interrupting said motor drive power supply wherein said printer driver further comprises a fuse for interrupting the drive power supply and means responsive to said second circuit for causing such a large current to flow through said fuse as to blow said fuse.

6. The protective circuit of claim 5, wherein said drive power supply provides a voltage higher than the rated voltage of the motor, and, in the normal operating state, the conduction of said motor drive transistor is terminated before the current through the coil becomes excessive.

7. The circuit of claim 5, wherein said control circuit comprises a microcomputer, and said resetting of said control circuit comprises resetting of said microcomputer.

8. The circuit of claim 7, wherein said first signal is produced when there is a malfunction of the microcomputer.

9. The circuit of claim 5, wherein said second signal is produced when there is a breakdown of said transistor.

10. A protective circuit for a printer driver having a motor drive transistor for permitting a current to flow through a motor from a drive power supply, a control circuit being associated with said printer driver for controlling the operation of said motor drive transistor, said protective circuit comprising:

a charge/discharge circuit for charging a capacitor through a resistor while said motor drive transistor is ON, and discharging said capacitor when said motor drive transistor is OFF;

a first circuit responsive to the potential on said capacitor and producing a first signal when the potential on said capacitor exceeds a first threshold value, and resetting said control circuit; and a second circuit responsive to the potential on said capacitor and producing a second signal when the potential on said capacitor exceeds a second threshold value which is higher than said first threshold value, and interrupting the drive power supply wherein said printer driver further comprises a fuse for interrupting the drive power supply and means responsive to said second circuit for causing such a large current to flow through said fuse as to blow said fuse 11. The protective circuit of claim 10, wherein said drive power supply provides a voltage higher than the rated voltage of the motor, and, in the normal operating state, the conduction of said motor drive transistor is terminated before the current through the coil becomes excessive.

12. The circuit of claim 10, wherein said control circuit comprises a microcomputer, and said resetting of said control circuit comprises resetting of said microcomputer.

13. The circuit of claim 12, wherein said first signal is produced when there is a malfunction of the microcomputer.

14. The circuit of claim 10, wherein said second signal is produced when there is a breakdown of said transistor.

* * * * *